US005973247A

United States Patent [19]

Matthews

[11] Patent Number: 5,973,247

[45] Date of Patent: Oct. 26, 1999

[54] PORTABLE STEEL DRUMS AND CARRIER

[76] Inventor: Wheeler Matthews, 311 Evergreen Forest Dr., Seneca, S.C. 29678

[21] Appl. No.: 08/734,587

[22] Filed: Oct. 22, 1996

[51] Int. Cl.[6] ..... G10D 13/08

[52] U.S. Cl. ..... 84/402; 84/421

[58] Field of Search ..... 84/402, 404, 406, 84/421

[56] References Cited

U.S. PATENT DOCUMENTS

| | | | |
|---|---|---|---|
| 3,974,732 | 8/1976 | Kester, Jr. | 84/421 |
| 4,634,032 | 1/1987 | LaFlame | 224/265 |

OTHER PUBLICATIONS

Steel Pan Tuning, Uif Kronman, Dec. 1991.

Lark in the Morning Catalog, Mendocino California Mar. 5, 1997 p. 100.

A Survey of Musical Instruments, Sibyl Marcuse, 1975, p. 53.

*Primary Examiner*—William M. Shoop, Jr.

*Assistant Examiner*—Shih-yung Hsieh

*Attorney, Agent, or Firm*—William D. Lee, Jr.; Cort Flint

[57] ABSTRACT

A portable steel drum assembly for use in a marching band includes a first steel drum having a defined playing surface including a first set of predefined indentations defining a first set of notes and a second steel drum having a defined playing surface including a second set of predefined indentations defining a second set of notes. The first and second steel drums each have a diameter less than twenty-two inches providing the steel drum assembly with sufficient light-weightness and compactness enabling a musician to perform the steel drum assembly while carrying the steel drum assembly. A steel drum carrier including a harness and a steel drum mount enables a musician to carry the first and second steel drums.

10 Claims, 3 Drawing Sheets

PORTABLE STEEL DRUMS AND CARRIER

BACKGROUND OF THE INVENTION

This invention relates to a percussion instrument used by marching bands, and more particularly to a lightweight portable steel drum assembly for being played by marching bands while marching.

The steel drum is a musical instrument which is generally crafted from discarded 55-gallon drums or barrels. The creation of the steel drum as a musical instrument is credited as originating from Ellie Mannette in 1946. To transform the discarded drum into a musical instrument, the 55-gallon barrel is first cut to a particular height such that one end of the barrel remains intact and the other end opens into the interior of the drum. The enclosed end of the barrel is deformed into the barrel's interior forming a concave surface. Indentations are formed in the concave surface and are of particular shapes and sizes for producing specific notes when struck by a musical hammer or mallet.

There are several types of steel drums which include a soprano, a double tenor, double second, and a triple guitar. These drums each have a different set of indentations for producing various tones and musical voices. The indentations are located around the internal periphery of the concave surface and also around the center of the concave surface in a discrete pattern for producing the separate notes. For instance, the soprano drum has a skirt which is approximately five to five and a half inches in length and contains twenty-nine discrete indentations for producing a range of notes including two complete octaves and part of a third.

Steel drums are used in orchestral settings and in marching bands. However, due to the heaviness and bulkiness of the steel drums, the steel drums are mounted on stands and remain stationary. A typical steel drum weighs fifteen to eighteen pounds. Thus a two piece ensemble weighs over thirty pounds. The stationary placement of the steel drums limits the participation of the musician involved with the marching band. Unlike the other musicians, the steel drum musicians are forced to remain on the sideline while the other members of the marching band perform in the flamboyant on field musical production.

Furthermore, since no steel drum has heretofore been designed for being played while the musician is marching, no portable mounting mechanism has been provided enabling a marching band member to play a steel drum while marching on the field.

Accordingly, it is an object of the present invention to provide a steel drum which is light weight and portable for playing by a marching band member while marching on the field;

Also, it is an object of the present invention to provide a portable light weight steel drum assembly which includes a sufficient range of notes for providing a musically viable instrument;

Furthermore, it is an object of the present invention to provide a portable light weight steel drum assembly with a particular layout of notes which enables the steel drum assembly to be easily played without requiring an awkward hand maneuver;

Additionally, it is an object of the present invention to provide a mounting mechanism enabling a musician to carry the light weight portable steel drum assembly in a playing position while marching on a field in a marching band.

SUMMARY OF THE INVENTION

The above objectives are accomplished according to the present invention by providing a portable steel drum assembly for use in a marching band which comprises a first steel drum having a defined playing surface including a first set of predefined indentations defining a first set of notes and a second steel drum having a defined playing surface including a second set of predefined indentations defining a second set of notes. The first and second steel drums each have a diameter less than twenty-two inches providing the steel drum assembly with sufficient lightweightness and compactness enabling a musician to simultaneously carry and perform the steel drum assembly.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
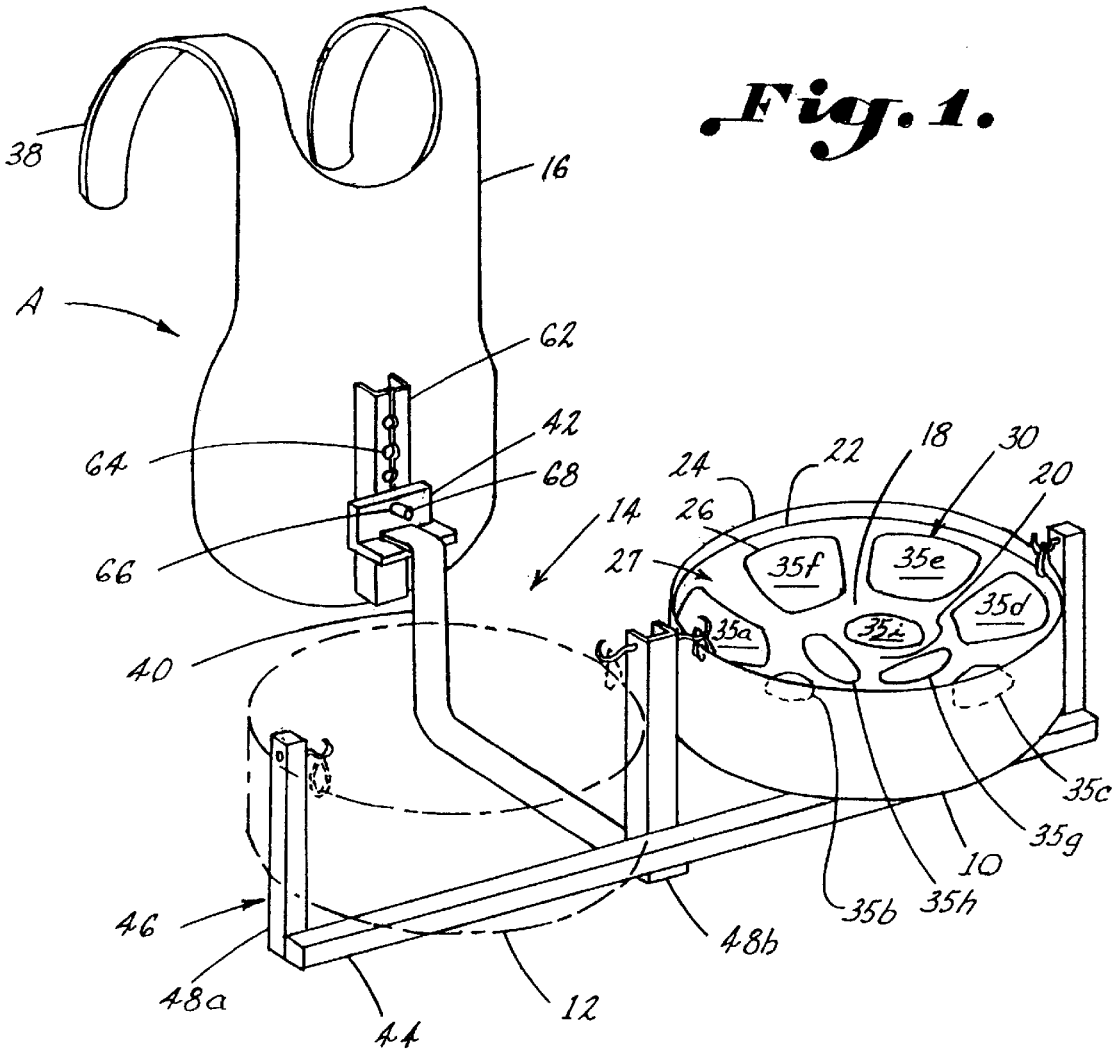
FIG. 1 is a perspective view of the steel drum assembly and portable carrier according to the invention.

FIG. 1 illustrates portable steel drum assembly A being carried by steel drum carrier B. Steel drum assembly A includes first steel drum 10 and second steel drum 12. Steel drum carrier B includes steel drum assembly support 14 which is connected with harness 16.

Figure 2:
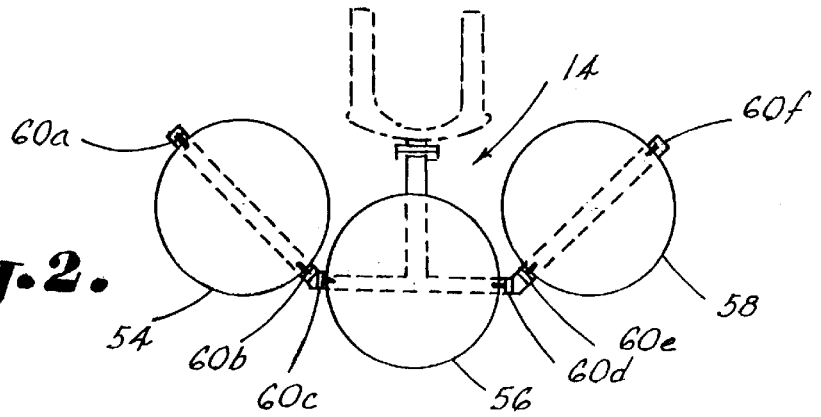
FIG. 2 is a top view of a second embodiment of a portable steel drum assembly and portable carrier according to the invention.
Figure 3:
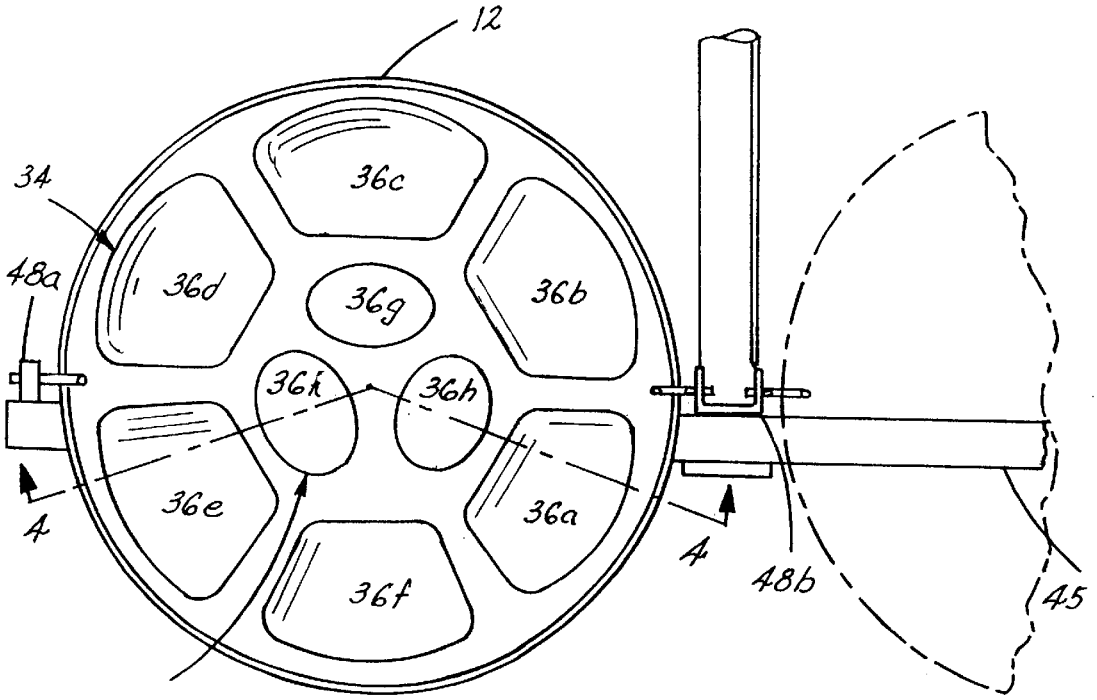
FIG. 3 is a top view of one of the steel drums illustrating the note arrangement according to the invention.

As shown in FIGS. 1 and 3, steel drum assembly A includes multiple steel drums for positioning in front of a musician marching in a marching band for playability. As shown in FIG. 2, a second embodiment of steel drums may include three steel drums. The selection of either a two or three drum arrangement depends on the type of music and range of notes desired to be played.

The first and second steel drums shown in FIG. 1 and FIG. 3 are generally identical in shape and size and vary only in the particular notes contained within the steel drum which are defined by the specific indentations and dimensions thereof and which will be described in more detail hereinafter.

The critical part of the invention is that the steel drums are lightweight and portable and have a set of notes defined within the small surface area which enables the steel drum assembly to provide a sufficient range of notes to make the steel drum assembly viable for playing marching band musical compositions. In order to make the drums lightweight, the steel drums have a smaller diameter than normal steel drums and are less than twenty-two inches in diameter. In the preferred embodiment, the drums are sixteen or fourteen inches in diameter. The skirt of the steel drums are preferably four inches. The small configuration of the steel drum weighs only four pounds. The lower portion of the steel drum is hollow and the upper area of the steel drum is indented to define playing surface 18. Playing surface 18 has a central depressed area 20 which is approximately three inches in depth and has upper rim 22 which is located within the interior of the steel drum approximately three fourths of an inch below the steel drum's outer rim 24. As shown in FIG. 3, the particular notes within the steel drum are defined by indentations 26 of a predetermined size which when struck will emit a certain pitch constituting a certain note.

Figure 5:
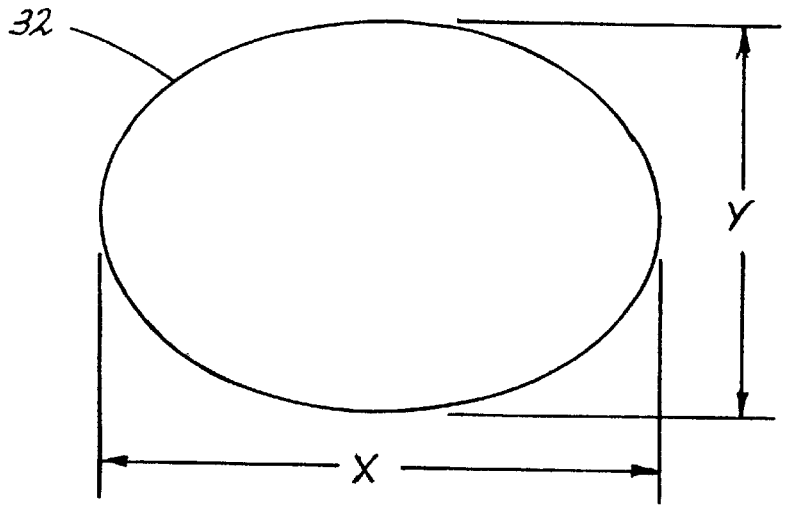
FIG. 5 is a schematic illustrating the configuration of the notes which are located in the center of the steel drum according to the invention.
Figure 6:
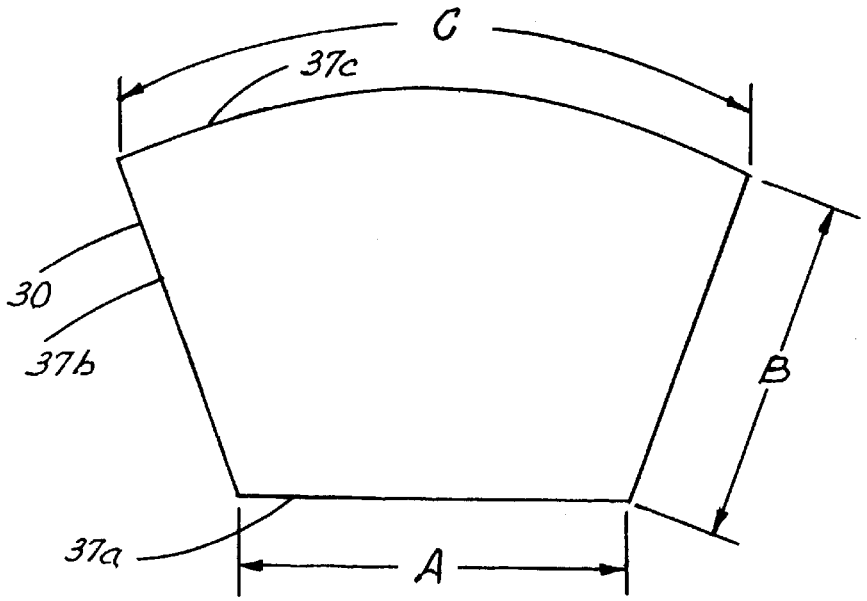
FIG. 6 is a schematic of the outer notes located along the internal periphery of the steel drum according to the invention.

As shown in FIG. 1, first steel drum 10 includes a first set of predefined indentations 27 defining a first set of notes. The first set of predefined indentations are arranged in two patterns. The first pattern includes an outer group of indentations 30 arranged along the upper rim 22 of centrally depressed area 20 and a central group of indentations 32 arranged around the center of central depressed area 20. As shown in FIG. 5, the central group of indentations 32 generally have an oval configuration and as shown in FIG. 6, the outer group of indentations 30 generally have a rectangular construction appearance with an arc. As shown in FIG. 3, second steel drum 12 includes a second set of predefined indentations 34 defining a second set of notes which are arranged in a similar pattern and are construction as those of first steel drum 10.

Figure 4:
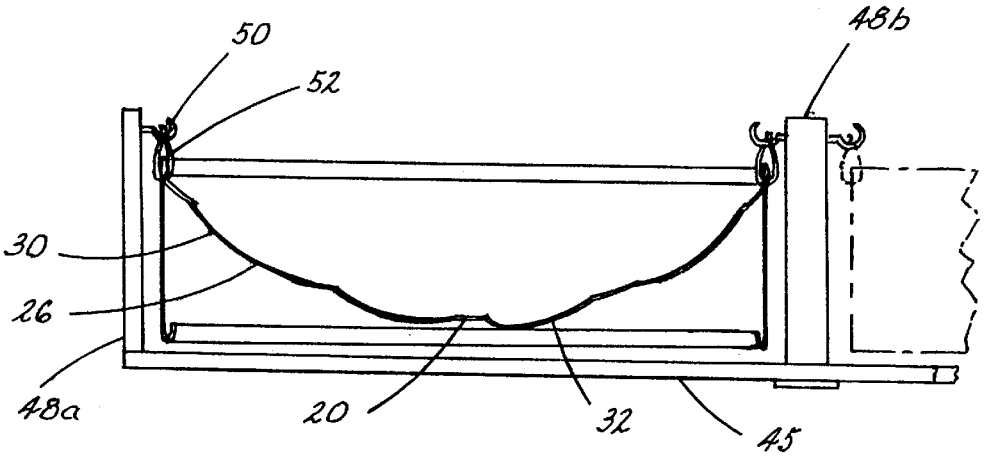
FIG. 4 is cut away view taken along line 4—4 of FIG. 3 illustrating the indentations comprising the notes of the steel drum and being carried by the portable carrier according to the invention.

FIG. 4 illustrates the construction of the indentations with the outer group of indentations 30 being located near the upper rim 24 of steel drum 12 and central group of indentations 32 being located at central depressed area 20.

A critical part of the invention is the specific surface area and configuration of the indentations included in the first and second set of predefined indentations 27 and 34 for defining a particular note. Due to the smaller diameter of the steel drums, a smaller surface area exists for indenting a group of notes within the steel drum. However, in order for the invention to be practical, the set of steel drums preferably provides a series of notes which constitute at least an octave and a half. Furthermore, the notes are preferably arranged in a desired pattern providing for a user friendly positioning of the notes so that the musician may easily play musical arrangements without requiring awkward or cumbersome hand formations.

In the preferred embodiment, first steel drum 10 includes the following notes defined by outer group of indentations: first E above middle C 35*a*, C 35*b*, G♯ 35*c*, D 35*d*, F♯ 35*e*, and B♭ 35*f* and are arranged with the E indentation 35*a* being located at the four o'clock position when positioned in front of the musician with the other remaining notes arranged sequentially counter-clockwise. Second steel drum 12 includes the notes F 36*a*, B 36*b*, E♭ 36*c*, G 36*d*, C♯ 36*e*, and A 36*f* and are arranged with the F indentation 36*a* being located at the four o'clock position when positioned in front of the musician with the other remaining notes arranged sequentially counter-clockwise. As illustrated in FIG. 6, in order to define these notes, the indentations constituting outer group of indentations 30 include a bottom wall 37*a* having dimensions defined as A in the following table, a pair of opposing sidewalls 37*b* having dimensions defined as B in the following table, and a top arc 37*c* having dimensions defined as C in the following table. The construction of the indentations are critical in providing the steel drum with playability.

The following table details the dimensions required for producing the outer rim notes:

| NOTES | A DIMENSION | B DIMENSION | C DIMENSION |
|---|---|---|---|
| E and F | 1 = 4 ¾" | 2 = 3 ¾" | 3 = 8 ¼" |
| C and C♯ | 1 = 3 ¾" | 2 = 3 ¾" | 3 = 6 ¼" |
| F♯ and G | 1 = 4 ½" | 2 = 3 ¾" | 3 = 7 ¾" |
| D and E♭ | 1 = 3 ¾" | 2 = 3 ¾" | 3 = 6" |
| G♯ and A | 1 = 4 ⅛" | 2 = 3 ¾" | 3 = 7 ¼" |
| B♭ and B | 1 = 4 ⅛" | 2 = 3 ¾" | 3 = 7" |

As shown in FIG. 5, the central group of indentations 32 are oval in shape having dimensions denoted as X and Y. Steel drum 10 includes the following notes defined by central group of indentations: E 35*g* which is an octave above E 35*a*, G♯ 35*h* which is an octave above G♯ 35*c*, and F♯ 35*i* which is an octave above F♯ 35*e*. Steel drum 12 includes the following notes defined by central group of indentations: F 36*g* which is an octave above F 36*a*, G 36*h* which is an octave above G 36*d*, and A 36*i* which is an octave above A 36*f*. The following table details the dimensions required for producing the notes:

| NOTES | X DIMENSION | Y DIMENSION |
|---|---|---|
| E and F | X = 3 ½" | Y = 2 ⅝" |
| F♯ and G | X = 3 ¼" | Y = 2 ½" |
| G♯ and A | X = 2 ¾" | Y = 2" |

Accordingly, as it can be seen in the preferred embodiment, each steel drum has six outer notes and three central notes, thereby providing eighteen notes which comprise an octave and a half.

As shown in FIG. 1, steel drum carrier B is used for transporting portable steel drum assembly A by a musician while performing on the marching field. Steel drum carrier B includes steel drum assembly support 14 which is attached to harness 16. Harness 16 includes shoulder straps 38 for resting on the shoulders of an individual.

As shown in FIG. 1, steel drum assembly support 14 includes extension member 40 which includes on a first end mounting face 42 for mounting steel drum assembly support 14 to harness 16 and for extending steel drums 10 and 12 away from the musician at a position whereby the musician may comfortably play the steel drums. In the preferred embodiment, extension member 40 is preferably ten inches in length. Attached to the distal end of extension member 40 is steel drum mount 44 which includes horizontal support arm 45 and a plurality of steel drum supports 46 which carries first and second steel drums 10 and 12 laterally in front of a musician.

As shown in FIGS. 1 and 3, a plurality of steel drum supports 46 extend upward from horizontal support arm 45 a sufficient height so that steel drums 10 and 12 may be suspended in a playable position. For the first embodiment which includes two steel drums, at least three steel drum supports 48*a*, 48*b* and 48*c* are provided for supporting steel drums 10 and 12 with support 48*b* being disposed between both drums. Suspension member 50 which may be hooks, extend from steel drum supports 46. Straps 52 are used for supporting steel drums 10 and 12 with suspension members 50. Straps 52 are preferably non-metallic so that the vibrations from the steel drums are not conducted through the straps to the hooks which would dampen the sound of the steel drums.

As shown in FIG. 2, in an alternative embodiment of the invention, should a steel drum assembly include three steel drums 54, 56 and 58, steel drum supports 46 may consist of a pair of steel drum supports 60*a* and 60*b* for drum 54, steel drum supports 60*c* and 60*d* for drum 56 and steel drum supports 60*e* and 60*f* for drum 58.

As shown in FIG. 1, steel drum assembly support 14 may be vertically adjusted with respect to harness 16. Harness 16 includes slotted mount 62 having a plurality of slots 64 and mounting face 42 includes mounting aperture 66 for receiving peg 68. Mounting face 42 may be positioned at any desired vertical height such that mounting aperture 66 is aligned with a respective slot 64. Peg 68 is inserted through mounting aperture 66 and slot 64 for maintaining steel drum assembly support 14 at a desired height depending on the desirability of the musician.

Thus it can be seen that a portable steel drum weighing only four pounds while still maintaining a sufficient surface area for providing for a set of notes which enables the steel drum to be viable may be had according to the invention.

While a preferred embodiment of the invention has been described using specific terms, such description is for illustrative purposes only, and it is to be understood that changes and variations may be made without departing from the spirit or scope of the following claims.

What is claimed is:

1. A portable percussion instrument for use in a marching band, said instrument comprising:

a first steel drum having a defined playing surface including a first set of predefined indentations defining a first set of notes;

a second steel drum having a defined playing surface including a second set of predefined indentations defining a second set of notes;

a steel drum carrier for carrying said first and second steel drums in a playing position; and means for mounting said first and second steel drums onto an individual for playing said first and second steel drums while marching, said means including a horizontal support member extending generally parallel to an individual's shoulders and carrying a plurality of steel drum supports extending upwards from said horizontal support member for supporting said first and second steel drums in a playable position.

2. The portable percussion instrument of claim 1 wherein said carrier includes a shoulder harness for resting upon the shoulders of an individual enabling said first and second steel drums to be transported by an individual in a playing position.

3. The portable percussion instrument of claim 2 wherein said steel drum carrier includes a steel drum mount carrying steel drum supports for supporting said first and second steel drums in a playable position.

4. The portable percussion instrument of claim 3 wherein said steel drum mount includes a horizontal support member extending generally parallel to an individual's shoulders and carrying a plurality of steel drum supports extending upwards from said horizontal support member for supporting said first and second steel drums in a playable position.

5. The portable percussion instrument of claim 1 wherein said plurality of steel drum supports includes at least a pair of supports for each steel drum for supporting each steel drum in a playable position.

6. The portable percussion instrument of claim 1 wherein said steel drum carrier includes an extension member carried by said steel drum carrier which extends outwardly away from said steel drum carrier and supports said horizontal support member for positioning said first and second steel drums in a playable position.

7. A device for carrying a plurality of steel drums in a playable position by an individual, said device comprising:

a harness for being carried on by an individual;

an extension arm for being mounted on said harness which extends outwardly away from said harness for positioning said steel drums in a playable position;

a steel drum mount carried by a distal end of said extension arm; and a plurality of steel drum supports extending upwards from said steel drum mount for supporting said plurality of steel drums in an upright playable position.

8. The device of claim 7 wherein said harness includes a slotted mount and said extension arm includes a mounting face adapted for being carried by said slotted mount.

9. The device of claim 8 wherein said mounting face includes a mounting aperture.

10. The device of claim 9 including a peg for being received by said mounting aperture for mounting said extension arm with respect to said slotted mount.

* * * * *